US006190024B1

(12) United States Patent
Hackett et al.

(10) Patent No.: US 6,190,024 B1
(45) Date of Patent: Feb. 20, 2001

(54) LAMPSHADE AND A METHOD FOR MAKING A LAMPSHADE

(76) Inventors: Dominic Anthony Hackett, Windrush, Shankill, County Dublin; Joseph Patrick Hackett, Ardclough, Straffan, County Kildare, both of (IE)

( * ) Notice: Under 35 U.S.C. 154(b), the term of this patent shall be extended for 0 days.

(21) Appl. No.: 09/155,877

(22) PCT Filed: May 2, 1997

(86) PCT No.: PCT/IE97/00035

§ 371 Date: Oct. 7, 1998

§ 102(e) Date: Oct. 7, 1998

(87) PCT Pub. No.: WO97/42448

PCT Pub. Date: Nov. 13, 1997

(30) Foreign Application Priority Data

May 2, 1996 (IE) ..... S960325
Oct. 16, 1996 (IE) ..... S960731

(51) Int. Cl.[7] ..... F21V 1/00; F21V 1/26

(52) U.S. Cl. ..... 362/356; 362/351; 362/357; 493/950

(58) Field of Search ..... 362/351, 353, 362/355, 356, 357, 361, 358; 493/950

(56) References Cited

U.S. PATENT DOCUMENTS 1,660,883 * 2/1928 Ober ..... 362/357
1,813,492 * 7/1931 Goodloe ..... 362/356
1,863,767 * 6/1932 Shapiro ..... 362/353 X
1,940,672 * 12/1933 Angeletti ..... 362/351
2,435,759 2/1948 Spaw ..... 240/108
4,605,996 * 8/1986 Payne ..... 362/357 X
5,193,902 * 3/1993 Hyland et al. ..... 362/357 X

FOREIGN PATENT DOCUMENTS 26 39 030 A1 3/1978 (DE) .
0 325 878 8/1989 (EP) .
1 372 263 10/1974 (GB) .

* cited by examiner

*Primary Examiner*—Laura K. Tso
(74) *Attorney, Agent, or Firm*—Nixon & Vanderhye PC

(57) ABSTRACT

A method for making a lampshade (1, 30) of the type which comprises at least one support ring (3, 4) and a side wall (5) secured to the support ring (3, 4) by a ligature (7), wherein the support ring (3, 4) comprises a plurality of ligature receiving means (16, 40, 44) at spaced apart locations along the support ring (3, 4), and a plurality of spaced apart apertures (15) are formed in the side wall (5) adjacent the support ring method comprising the steps of inserting respective portions of the ligature (7) sequentially into the wall apertures (15), and securing the respective portions of the ligature (7) to the ligature receiving means (16, 40, 44) on the support ring (3, 4).

24 Claims, 5 Drawing Sheets

LAMPSHADE AND A METHOD FOR MAKING A LAMPSHADE

The present invention relates to a lampshade, and to a method for making the lampshade.

Lampshades are provided in many shapes and forms, and are provided for use in connection with table lamps, standard lamps, ceiling suspended lights and the like. Typically, such lampshades comprise an upper support ring and a lower support ring, and a side wall or side walls extend between the upper and lower rings. The side wall may be an endless wall which extends completely around and between the two rings, or it may be formed in segments which extend between the two rings and are spaced apart circumferentially around the two support rings. The side wall or walls are secured to the upper and lower rings, and may be secured by adhesive, stitching or, indeed, by folding around the upper and lower support rings. Such forms of construction of lampshade will be well known to those skilled in the art.

One particular type of lampshade comprises an upper and a lower support ring and a single endless side wall or a plurality of side walls extending between the support rings, and the side wall or side walls is secured to one or both support rings by a ligature, which may be of leather, textile, such as, for example, a ribbon, coarse twine, wire or the like, or cord. The side wall or walls are provided with a row of spaced apart apertures adjacent one or both the top and bottom edges of the side wall or side walls and the ligature is threaded sequentially through the apertures and wound around the adjacent support ring in a helical form. Such construction of lampshade, though it has been well known for many years has recently become increasingly popular. However, the manufacture of such lampshades is particularly tedious and time consuming. The ligature must be threaded through each aperture, and wound around the adjacent support ring and a portion of the side wall or walls of the lampshade between the apertures and the edge thereof. The ligature requires pulling through all the apertures, and the entire length of the ligature must be pulled through the first aperture, and virtually the entire length of the ligature must be pulled through the second aperture, and so on until the ligature has been passed through all the apertures. This, it will be appreciated is a particularly time consuming task, and does not lend itself to mass production of this type of lampshade.

European Patent Specification No. 325878 discloses a lampshade with a removable cover in which the removable cover is a skirt. The skirt is held in place with a combination of flaps, strips, and annular metal components. However, the patent specification does not disclose or suggest a method which obviates the need for time-consuming threading procedures in the mass production of lampshades having a ligature component in its assembly.

A need exists for an improved method for making a lampshade of the aforementioned type. A need also exists for a lampshade of the aforementioned type having an improved construction.

An object of the invention is to provide an improved simplified method for making a lampshade.

A further object of the invention is to provide an improved lampshade having a simplified construction.

Yet a further object of the invention is to provide an improved method of manufacturing a lampshade which obviates the need for threading of a ligature but results in a lampshade having a component resembling a threaded ligature.

According to the invention there is provided a method for making a lampshade of the type which comprises at least one support ring, and a side wall secured to the support ring by a ligature, wherein the support ring comprises a plurality of ligature receiving means at spaced apart locations along the support ring, and a plurality of spaced apart apertures are formed in the side wall adjacent the support ring for receiving the ligature, the method comprising the steps of:

inserting respective portions of the ligature sequentially into the wall apertures, and securing the respective portions of the ligature to corresponding ones of the ligature receiving means on the support ring.

In one embodiment of the invention a first access means is provided to each wall aperture, the respective first access means extending from a side edge of the wall adjacent the wall apertures to the corresponding wall aperture for accommodating the corresponding portion of the ligature into the corresponding wall apertures.

In another embodiment of the invention a second access means is provided in the support ring to each ligature receiving means for accommodating respective portions of the ligature to the corresponding ligature receiving means.

In a further embodiment of the invention each ligature receiving means is formed by an aperture extending through the support ring.

Preferably, prior to inserting the portions of the ligature into the corresponding wall and ring apertures, the respective wall and ring apertures and their corresponding first and second access means are aligned for receiving the said portions of the ligature, and preferably, the said portions of the ligature are passed sequentially through the respective first and second access means to the wall and ring apertures, simultaneously.

Advantageously, on being inserted into one of the corresponding wall and ring apertures the ligature is pulled taut. Preferably, the ligature is pulled taut at the outer side of the side wall and the support ring assembly from an inner side of the side wall to the outer side thereof.

In one aspect of the invention the ligature is inserted through respective adjacent wall and ring apertures to give the effect of a helically wound ligature around the ring and a portion of the side wall intermediate the wall apertures and the adjacent side edge of the side wall.

Preferably, the first and second access means are provided by first and second access slits or slots, respectively, and advantageously, the first and second access slots are inclined to the side edge of the side wall adjacent the wall apertures, and when viewed from the outer side of the side wall the first access slots define a part of each wind of the helix formed by the ligature so that the first access slots are concealed by corresponding adjacent portions of the ligature which extends from the respective wall apertures to the adjacent side edge and which coincide with the respective first access slots.

Preferably, while being pulled taut the portion of the ligature adjacent the outer side of the side wall adjacent the side edge is held adjacent the first access slot for preventing the ligature being pulled through the first access slot a second time.

Advantageously, the ligature is pulled taut each time a portion of the ligature is inserted through one of the wall and ring apertures for tightening a portion of the ligature extending between that wall and ring aperture and the next adjacent wall and ring aperture through which the ligature had previously been inserted.

Alternatively, each ligature receiving means comprises a grip means which is located in the support ring, and preferably, each grip means is located in a corresponding one of the second apertures in the support ring. Preferably, the respective portions of the ligature are inserted through the respective corresponding wall apertures for engaging the grip means.

Suitably, the grip means comprises resiliently deformable slits deformable inwards when one of the portions of the ligature is urged against the slits.

Preferably, prior to inserting the ligature into the corresponding wall and ring apertures, the respective wall and ring apertures are aligned for receiving the said ligature.

Most preferably, a first end of the ligature is first secured in an aligned pair of wall and ring apertures and the ligature is doubled adjacent the subsequent wall and ring apertures and inserted through the wall aperture and the grip means.

Additionally, the invention provides a lampshade comprising a side wall and at least one, and preferably two support rings, the support rings being spaced apart, and being located adjacent a top and bottom edge of the side wall, the side wall being secured to each support ring by a ligature of which a plurality of portions are inserted into respective spaced apart apertures formed in the side wall adjacent the support ring, the said portions of the ligature securing the side wall to the support ring by engaging respective spaced apart ligature receiving means on the support ring, the respective corresponding wall apertures and ligature receiving means being aligned for receiving the ligature.

In one embodiment of the invention each ligature receiving means comprises a grip means for receiving and securing the ligature in the support ring. Preferably, each grip means is located in a corresponding aperture which extends through the support ring. Ideally, the grip means is a non-return type grip means.

Preferably, a portion of the ligature extending between one wall aperture and its next adjacent wall aperture is pulled taut as the ligature is being inserted into the said next adjacent wall aperture and corresponding ligature receiving means.

Alternatively, a first access means is provided to each wall aperture, each first access means extending from an adjacent side edge of the side wall to the corresponding wall aperture for accommodating the ligature into the wall aperture, and preferably, a second access means is provided in the support ring for each ligature receiving means, each second access means extending from a side edge of the support ring which corresponds with a side edge of the side wall to the corresponding receiving means for accommodating the ligature into the ligature receiving means. Advantageously, the first and second access means comprises a first and second access slit or slot, respectively. Ideally, the respective first and second access slots are inclined relative to the adjacent side edges of the side wall, and define part of one wind of a helix. Preferably, the ligature is engaged in the wall aperture and the ligature receiving means to appear as though it were wound in the form of a helix around the support ring and a portion of the side wall between the wall apertures and the adjacent side edge of the side wall. Preferably, portions of the ligature extending from wall aperture to the adjacent side edge of the side wall lie along and conceal the corresponding first access slot.

Preferably, the wall apertures are located adjacent the side edge of the side wall which is adjacent to the corresponding support ring.

In another embodiment of the invention the ligature comprises an elongate strip of leather. In an alternative embodiment of the invention the ligature comprises an elongate cord.

In an alternative embodiment of the invention a method for the manufacture of a lampshade is provided in which the ligature is secured to one or more of the ligature receiving means on the ring at least every second time a portion of the ligature is passed through an aperture and the ligature is tightened onto the ligature receiving means.

Preferably, the ligature is secured to one of the ligature receiving means each time a portion of the ligature is passed through the aperture and more preferably, the portions of the ligature are passed through the apertures to form a loop each loop being secured to a ligature receiving means.

Suitably, the apertures are located adjacent an edge of the side wall, and an access means is provided to each aperture from the adjacent edge and the ligature is entered into each aperture through the access means.

Advantageously, the access means is formed by a slit extending between the aperture and the edge of the side wall. Suitably each ligature receiving means comprises a hook extending from the ring.

In a preferred embodiment, the hook extends between the ring towards a centre of the ring.

Preferably, a groove is formed in the ring adjacent each hook for accommodating the ligature from the corresponding aperture in the side wall to the hook.

Advantageously, a top ring and a bottom ring is provided, the top and bottom rings being spaced apart and the side wall extending between the respective rings, and the side wall extends completely around the ring. Advantageously, the side wall is endless.

The invention also provides a lampshade comprising at least one ring and a side wall secured to the ring by a ligature wherein the ring comprises a plurality of spaced apart ligature receiving means and a plurality of spaced apart apertures formed in the side wall adjacent the ring for receiving the ligature, the ligature extending sequentially through the apertures and being secured to the respective ligature receiving means, the ligature being passed over one or more ligature receiving means at least every second time the ligature is passed through the aperture without the need for winding the ligature in helical form around the ring.

Suitably, the ligature engages one of the ligature receiving means each time it passes through an aperture.

Preferably, the ligature is in the form of a plurality of loops passed through corresponding apertures and engaged on corresponding ligature receiving means and the apertures are located adjacent an edge of the side wall.

Suitably, an access means is provided to each aperture from the edge, and the access means comprises a slit extending from a corresponding aperture to the edge of the side wall.

Preferably, the ligature receiving means comprises a hook, and the hook extends from the ring towards a centre defined by the ring.

Preferably, a pair of rings are provided, namely, the top ring and the bottom ring which are spaced apart from each other, and the side wall extends between the top and bottom ring. Preferably, the side wall extends completely around the rings, and advantageously, the side wall is of frusto conical shape.

The invention will be more clearly understood from the following description of some embodiments thereof which are given by way of example only with reference to the accompanying drawings, in which.

Figure 14:
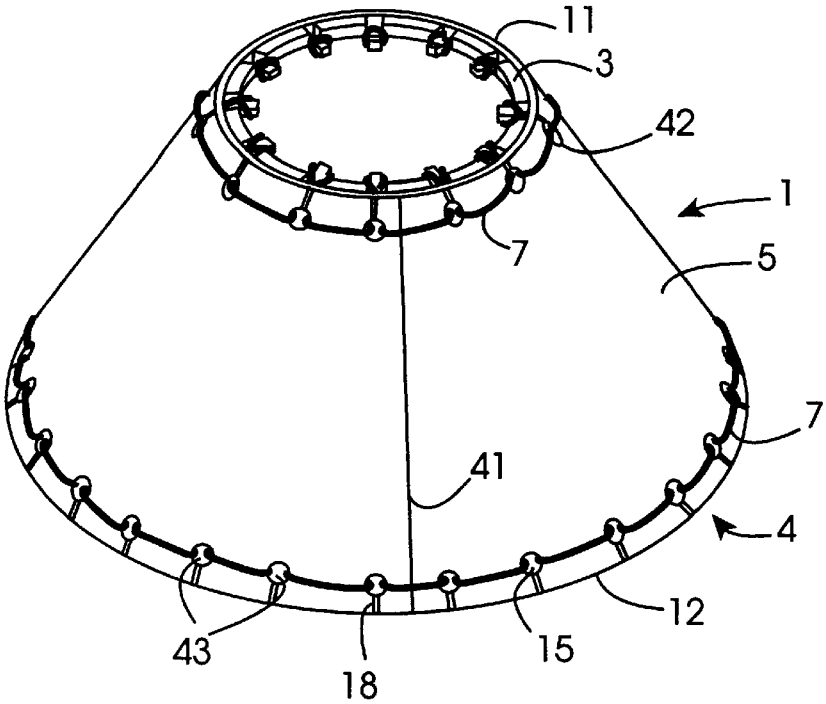
Figure 16:
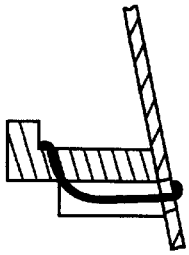
Figure 15:
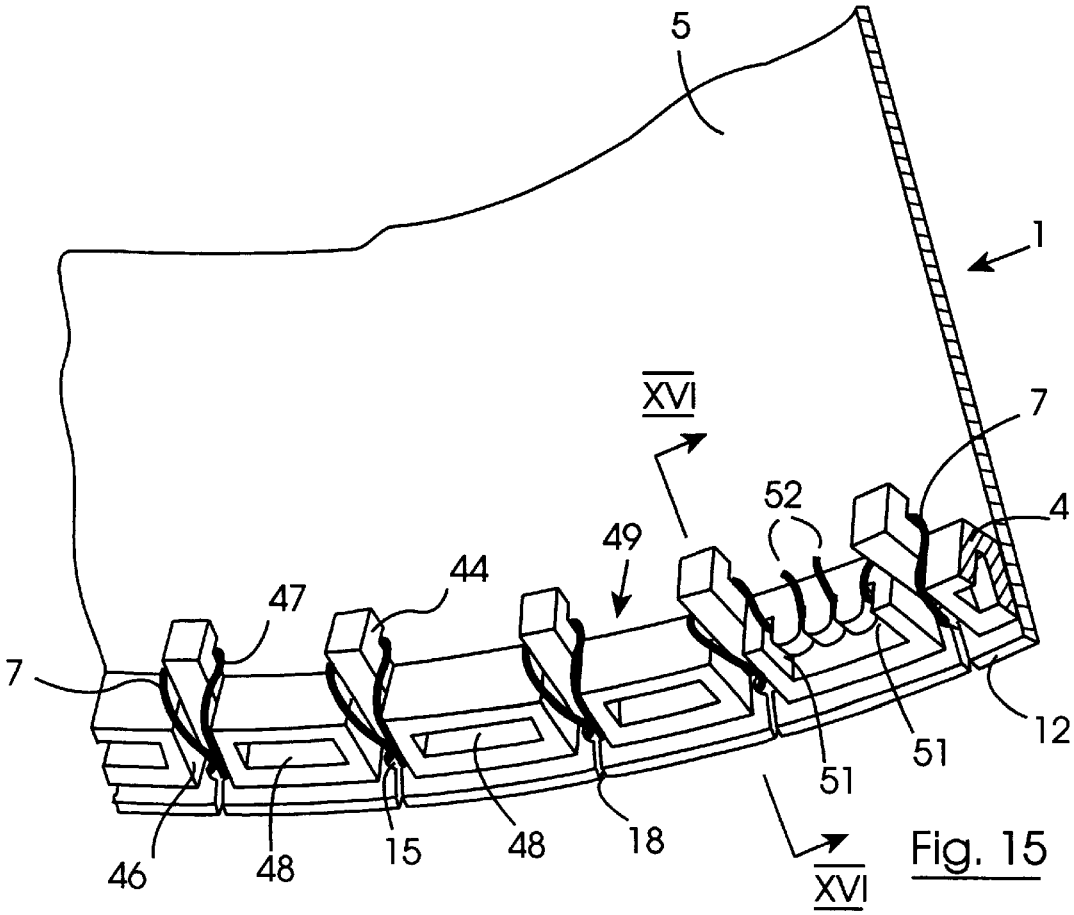
Figure 17:
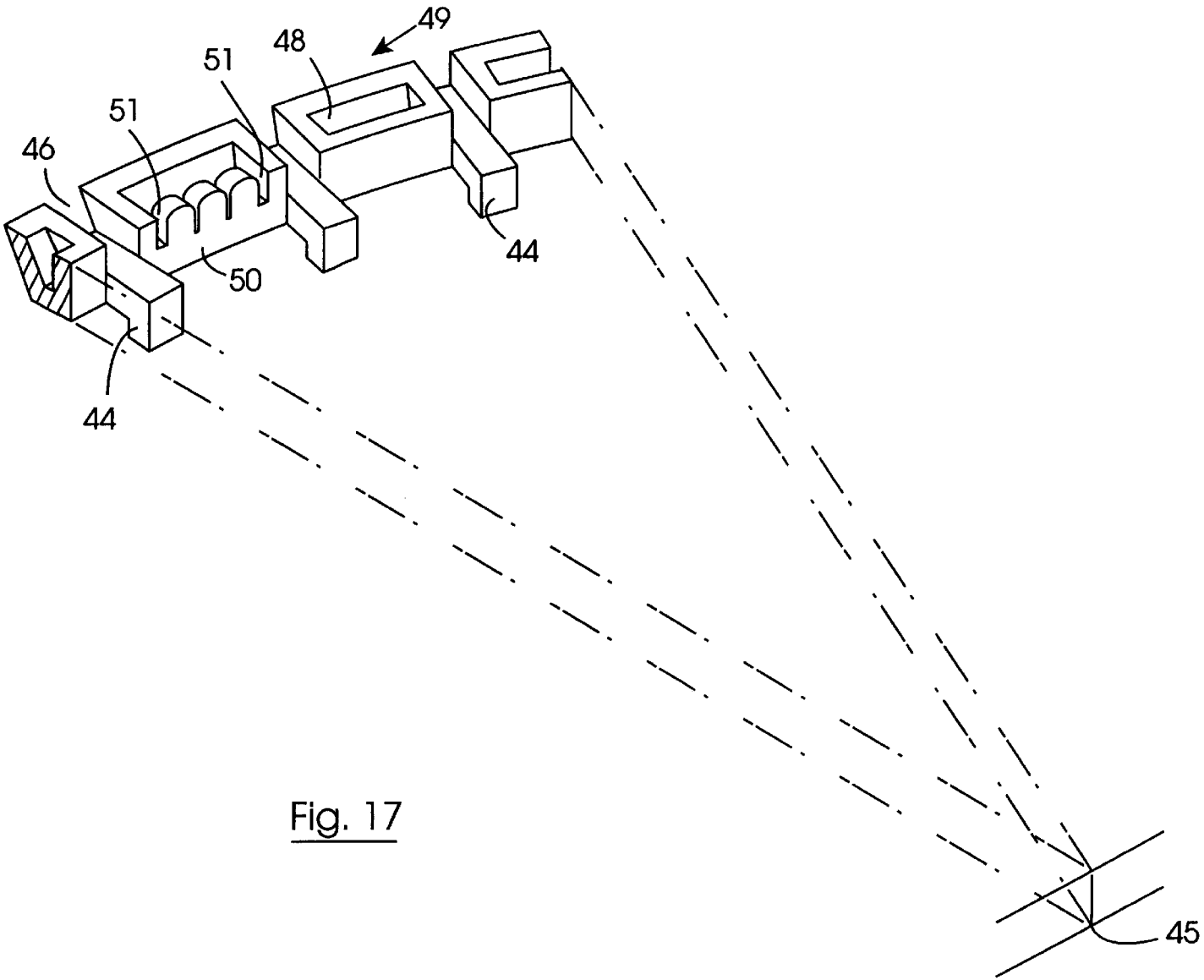

FIG. 14 is a perspective view of a lampshade according to a third embodiment of the invention, FIG. 15 is a perspective view of a detail of the lampshade of FIG. 14, FIG. 16 is a cross-sectional side elevational view of a detail of the lampshade on the line XVI—XVI of FIG. 15, and FIG. 17 is a perspective view of another detail of the lampshade of FIG. 14 relative to a centre of the rings of the lampshade.

Referring to the drawings and initially to FIGS. 1 to 9 thereof, there is illustrated a lampshade according to the invention which is indicated generally by the reference numeral 1. The lampshade 1 as well as being in accordance with the invention is also made by a method according to the invention which will be described below. The lampshade 1 is provided with a mounting frame 53 for mounting the lampshade on a lamp or other light fitting. The mounting frame 53 is shown in broken lines for clarity. As will be appreciated by those skilled in the art, the mounting frame 53 can be of a variety of types and can be integral with the lampshade 1 or attachable to the lampshade 1. The mounting frame 53 has been omitted from FIGS. 2 to 17 for clarity.

The lampshade 1 comprises a pair of support rings, namely, a top support ring 3 and a bottom support ring 4, both of plastics material. A side wall 5 of a flexible resilient plastics material extends between and completely around the support rings 3 and 4, and overlaps the rings 3 and 4. The side wall 5 is secured to the top and bottom reinforcing rings 3 and 4 by respective ligatures 7, which are not illustrated in FIG. 1. The ligatures 7 are typically of cord and are in the form of a helix. The top and bottom support rings 3 and 4 comprise an annular reinforcing section 8 and a relatively thin annular portion 9 extending from the reinforcing section 8. The portions 9 of the respective rings 3 and 4 terminate in side edges 10, which when the side wall 5 is secured to the rings 3 and 4 coincide with corresponding top and bottom edges 11 and 12, respectively, of the side wall 5. The thin portion 9 of the bottom support ring 4 diverges outwardly and takes up the approximate angle of divergence of the side wall 5, while the thin portion 9 of the top support ring converges inwardly to take up the approximate angle of convergence of the side wall 5 adjacent the top ring 3.

Two rows of spaced apart apertures 15 are provided in the side wall 5 adjacent but spaced apart in from the top and bottom side edges 11 and 12 for receiving the ligatures 7. A plurality of spaced apart ligature receiving means, each of which is provided by an aperture 16 are located in the thin portions 9 of the respective top and bottom support rings 3 and 4, also for receiving the ligatures 7. The ring apertures 16 are alignable with the corresponding wall apertures 15. To avoid having to thread the ligatures 7 through the respective wall and ring apertures 15 and 16, respectively, a plurality of first and second access means are provided in the side wall 5 and the thin portions 9 of the support rings 3 and 4. The first access means are provided by first access slits or slots 18 which extend from the top and bottom side edges 11 and 12 of the side wall 5 to the wall apertures 15. The second access means are provided by respective second access slits or slots 20 which extend from the side edges 10 of the support rings 3 and 4 to the ring apertures 16. The first access slots 18 and the second access slots 20 are also alignable with each other.

The first and second access slots 18 and 20 are inclined to the respective top and bottom edges 10, 11 and 12, and define part of the helix formed by the respective ligatures 7, so that portions 21 of the ligatures 7 which extend between respective ones of the wall apertures 15 and the top or bottom edge 11 or 12 of the side wall extend over the corresponding first access slots 18 for concealing the access slots 18. The dimensions of the first and second access slots 18 and 20, and the diameter of the ligatures 7 are so chosen that once assembled there is no danger of the ligatures 7 passing back into any of the access slots 18 and 20, which would thus cause disengagement of one of the ligatures 7 from the corresponding ring and wall apertures 15 and 16.

Figure 1:
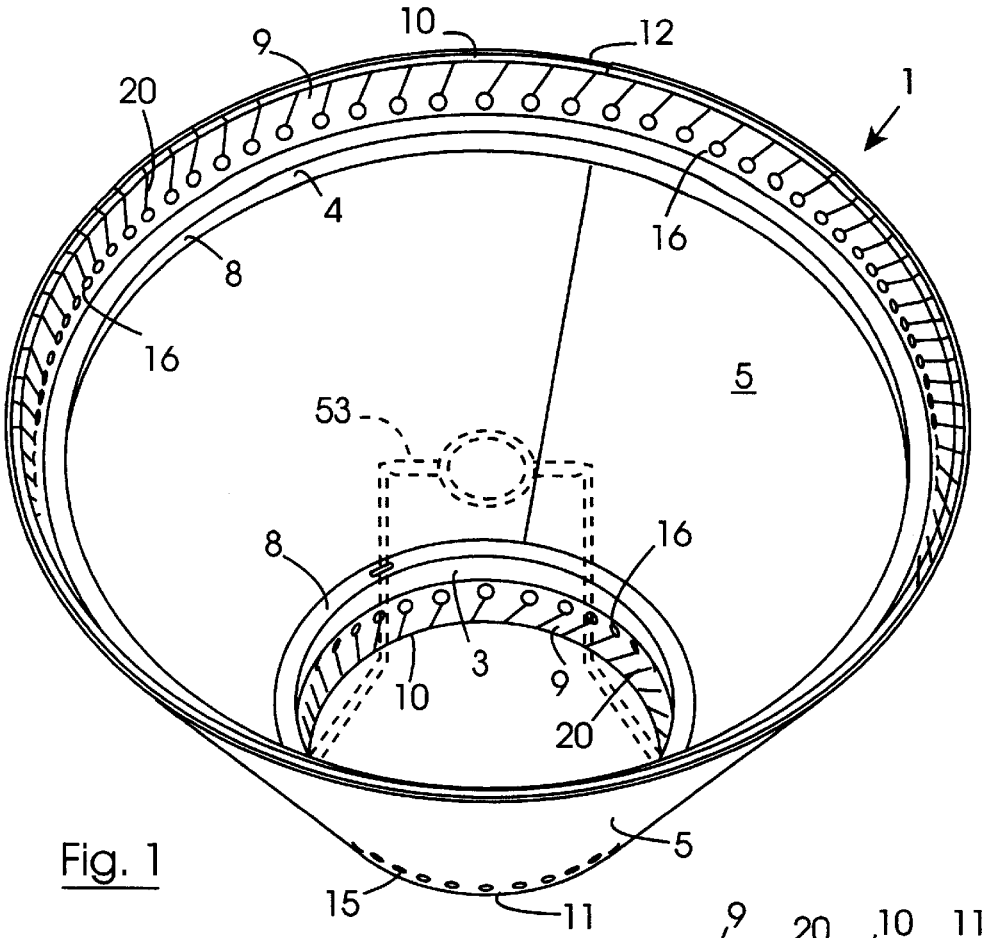
FIG. 1 is an underneath perspective view of a lampshade according to the invention.
Figure 9:
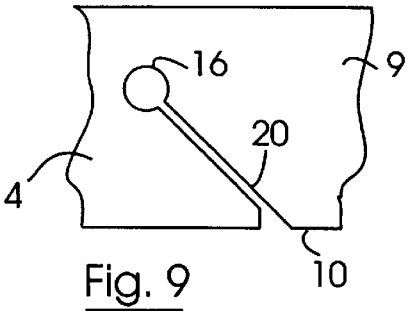
FIG. 9 is an elevational view of a detail of the lampshade of FIG. 1.
Figure 7:
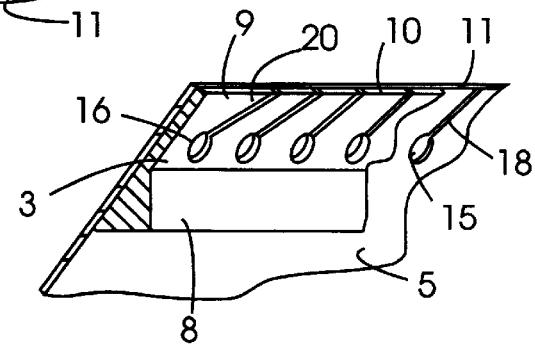
FIG. 7 is a perspective view of one portion of the lampshade of FIG. 1.
Figure 8:
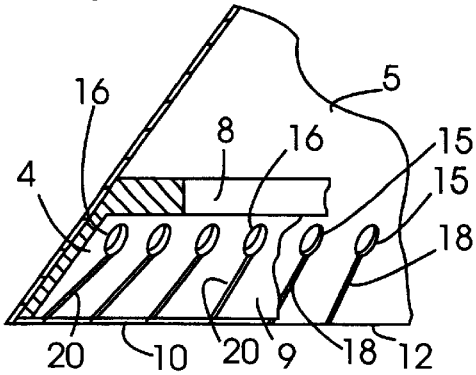
FIG. 8 is a perspective view of another portion of the lampshade of FIG. 1.
Figure 2:
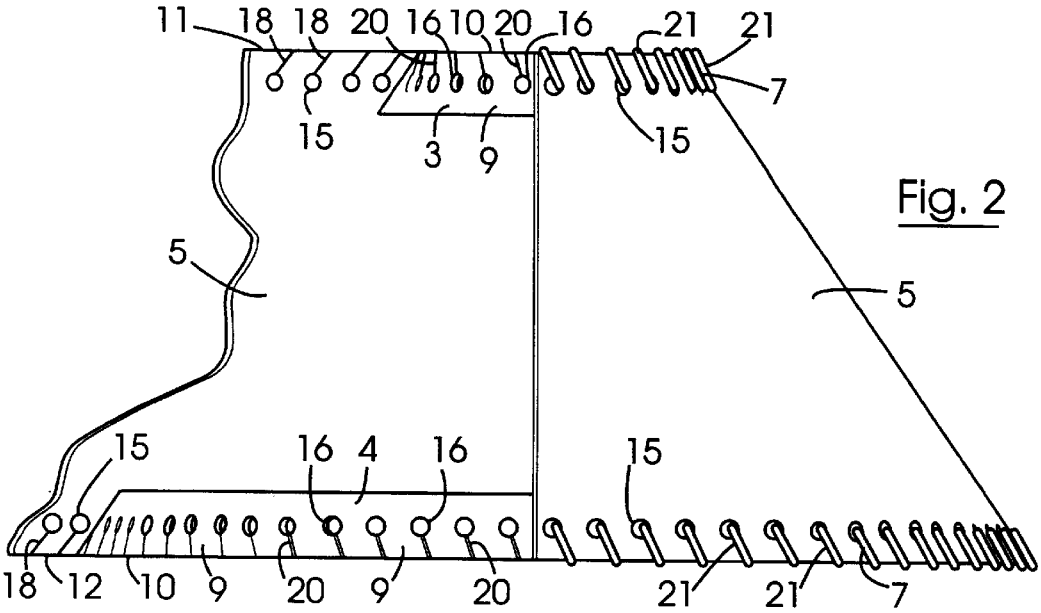
FIG. 2 is a front elevational view of the lampshade of FIG. 1 under construction.
Figure 3:
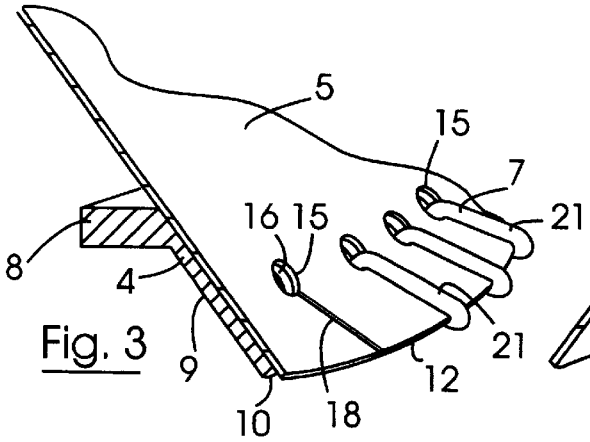
FIGS. 3 and 4 are perspective views of a detail of the lampshade of FIG. 1 from respective opposite directions.
Figure 4:
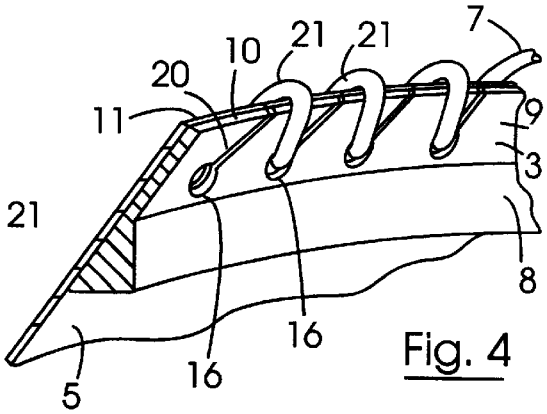
Figure 5:
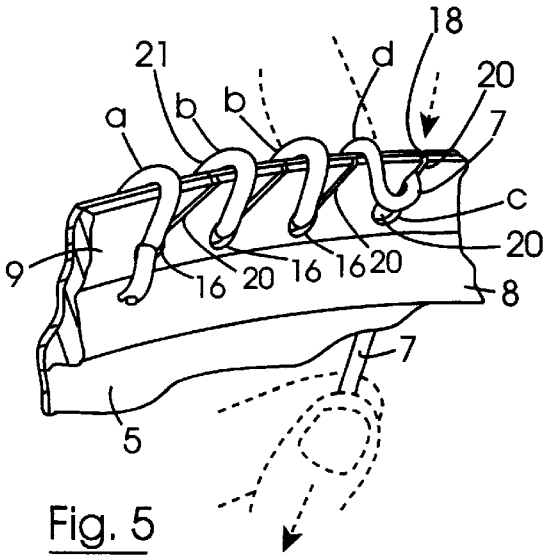
FIGS. 5 and 6 are perspective views of the details of FIGS. 3 and 4 illustrating the method for constructing the lampshade.
Figure 6:
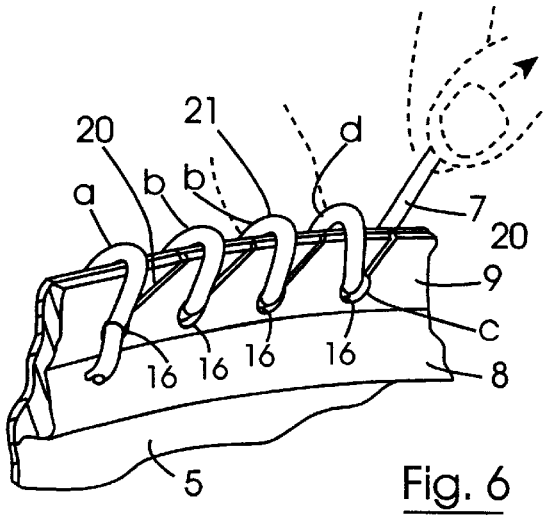
Figure 12:
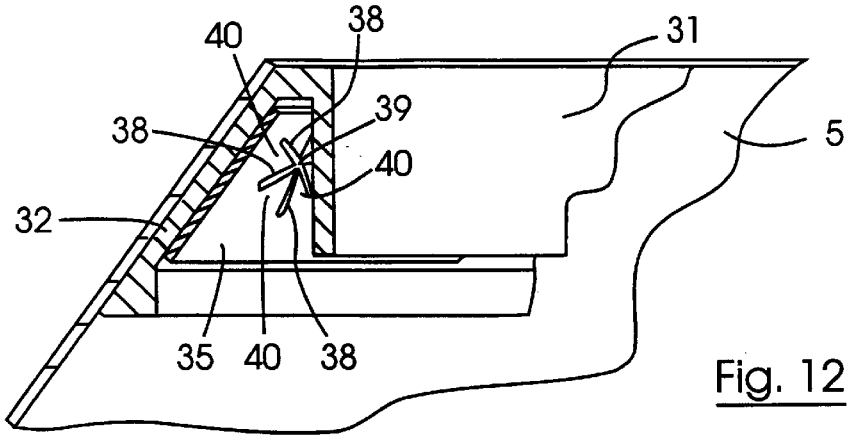
FIG. 12 is a perspective view of the detail of FIG. 11 of the lampshade of FIG. 10.
Figure 13:
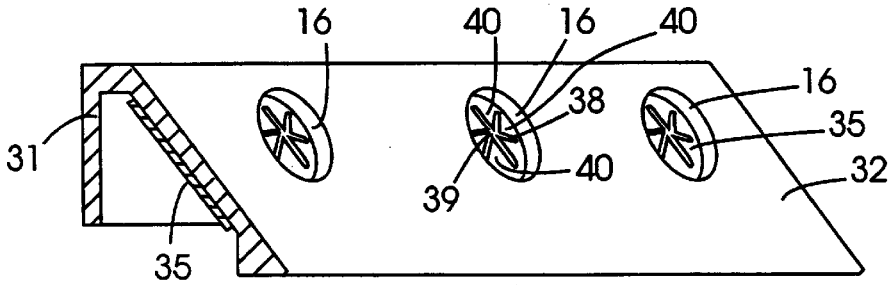
FIG. 13 is a perspective view of a portion of the lampshade of FIG. 10.
Figure 11:
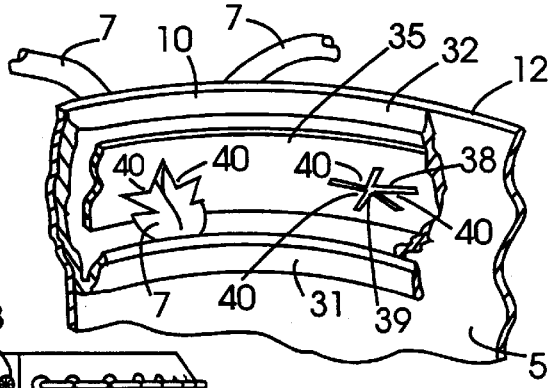
FIG. 11 is a cut-away perspective view of a detail of the lampshade of FIG. 10.

The lampshade 1 is made according to the method of the invention which is as follows. Initially, the side wall 5 and top and bottom support rings 3 and 4 are held together, typically, by a few dots of a suitable adhesive located at spaced apart intervals around the support rings 3 and 4 between the respective rings 3 and 4 and the side wall 5. A first loop of the ligature 7 is formed as illustrated in FIGS. 5 and 6 by the reference a. The first loop a is passed through one of the wall and ring apertures 15 and 16. The ligature 7 is then inserted into the next adjacent wall and ring apertures 15 and 16 by urging a portion of the ligature 7 through the corresponding first and second access slots 18 and 20 into the said next adjacent wall and ring apertures 15 and 16. In FIGS. 5 and 6 the first two loops b of the helix formed by the ligature 7 are illustrated having been formed, and the next loop of the helix is being formed. After the previous loop has been formed the ligature 7 is then urged into the first and second access slots 18 and 20 of the next wall and ring apertures 15 and 16 which are indicated by the reference letter c in FIGS. 5 and 6. While the portion of the ligature 7 which is being urged through the access slots 18 and 20 into the apertures c a portion of the ligature which forms the loop of the helix which is being formed is held by the thumb or a finger at d which is adjacent the edge 11 or 12 of the side wall 5, and also adjacent the entry of the previous access slots 18 and 20. While being held at the position d a portion of the ligature 7 is arranged to extend along and to conceal the previous first access slot 18. On being urged into the wall and aperture slots c the ligature 7 is then pulled tightly to form the loop of the helix. However, excess tension is not applied to the ligature 7 in order to avoid any danger of the ligature 7 re-entering the previous first and second access slots 18 and 20 at the point d. The ligature 7 is illustrated in FIG. 6 having been entered in the wall and ring apertures c and being pulled taut to form the loop of the helix. This process continues until the ligature 7 has been inserted in all the wall and ring apertures 15 and 16 of the top or bottom support ring 3 or 4, and then the method is repeated for securing the side wall 5 to the other of the top and bottom support rings 3 and 4 with the ligature 7.

Referring now to FIGS. 10 to 13 there is illustrated a lampshade 30 according to a second embodiment of the invention. The lampshade 30 is substantially similar to the lampshade 1, and similar components are identified by the same reference numerals. The main difference between the lampshade 30 and the lampshade 1 is in the respective top and bottom support rings 3 and 4 and the fact that first and second access slots 18 and 19 to the wall and ring apertures 15 and 16 are not required. In this embodiment of the invention instead of the ligatures 7 being wound in the form of a helix, the ligatures 7 are secured to the side wall 5 and top and bottom support rings 3 and 4 in the form of stitching.

The top and bottom support rings 3 and 4 comprise a reinforcing section 31 from which a relatively thin portion 32 extends. The ring apertures 16 are formed in the thin portion 32. Ligature receiving means in this embodiment of the invention are provided by a plurality of sets of spaced apart slits 38 formed in a strip 35 of resilient flexible material which radiate outwardly from a central point 39. The strip 35 is bonded to the thin portion 32 of the respective support rings 3 and 4 with the sets of slits 38 aligned with the corresponding ring apertures 16. Each set of slits 38 defines resiliently deformable portions 40 which deform inwardly on one of the portions of the ligature 7 being urged in through the ring apertures 16, and then retain that portion of the ligature 7 in secure engagement therewith thereby preventing withdrawal of the portion of the ligatures 7.

The lampshade 30 is made according to the method of the invention as follows. Initially, the side wall 5 is secured to the top and bottom rings 3 and 4 with corresponding wall and ring apertures 15 and 16 aligned. Typically, the side wall 5 is secured to the top and bottom rings 3 and 4 by a few dots of adhesive between the side wall 5 and the respective rings 3 and 4 as already described. The ligatures 7 are then secured to the top and bottom of the lampshade 30.

In an alternative method of making the lampshade 30, the side wall 5 is first formed and pre-moulded top and bottom rings 3 and 4 simply placed in the inverted lampshade 30. Typically, injection moulded rings 3 and 4 are used. Injection moulded plastics rings 3 and 4 have the advantage that the dimensions of same can be accurately reproduced in manufacture. Accordingly, the rings 3 and 4 can be dimensioned to be automatically correctly positioned in an inverted lampshade under the force of gravity adjacent the edges of the lampshade 30 without requiring the use of adhesive to locate the rings 3 and 4.

Figure 10:
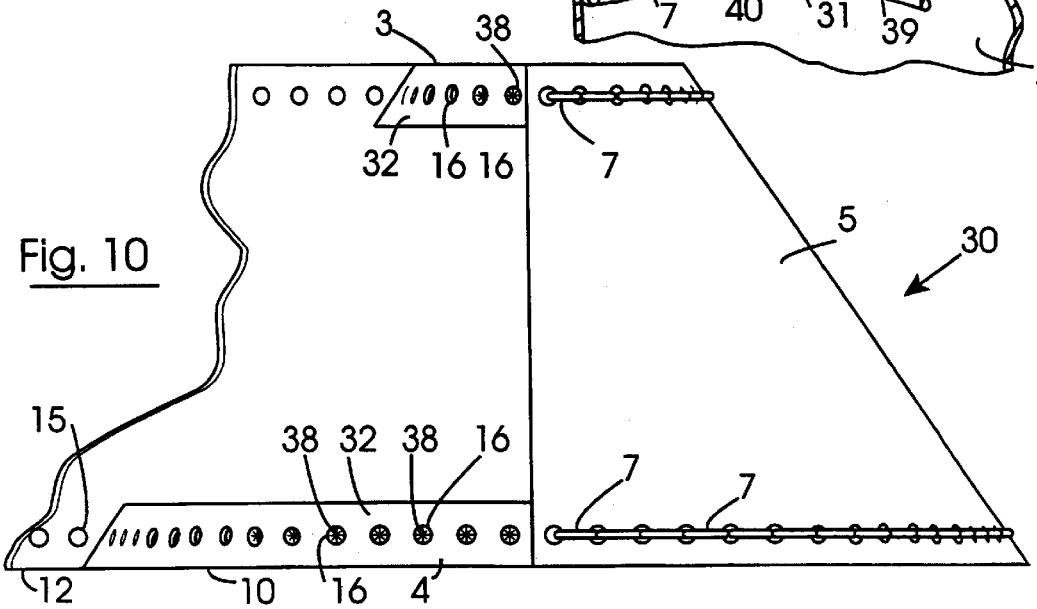
FIG. 10 is a front elevational view similar to FIG. 2 of a lampshade according to a second embodiment of the invention.

One end of the ligature is secured in any one of a corresponding pair of the wall and ring apertures 15 and 16 which is selected, and the ligature is then lightly stretched is doubled adjacent the next wall and ring apertures 15 and 16 and inserted through the wall aperture 15, and in turn the ring aperture 16 and secured in the slits 38. This method is continued until the ligature 7 is secured through the side wall 5 to the top or bottom support ring 3 or 4 to form a row of stitching as illustrated in FIG. 10. The second ligature 7 is then secured in similar fashion through the side wall 5 to the other of the top and bottom support ring 3 and 4.

FIGS. 14 to 17 show a third embodiment of a lampshade 1 in accordance with the invention which is made by a method also according to the invention which will be described in detail below. The lampshade 1 is broadly similar to those shown in FIGS. 1 to 13 in that it comprises a side wall 5 of semi-rigid material, which in this case is a plastics material, and which is of frusto conical shape. The side wall 5 is secured to an upper ring 3 and a lower ring 4 by respective ligatures 7 which in this case are provided by elongate strips of leather. The side wall 5 is formed from a single sheet of plastics material which is cut to shape and secured along a seam 41 by adhesive to form what is effectively an endless side wall 5. A plurality of spaced apart apertures 15 are arranged in two rows in the sidewall 5, namely, an upper row 42 and a lower row 43 for accommiodating the respective ligatures 7 to the upper and lower rings 3 and 4, respectively. The rows 42 and 43 of apertures 15 are located relatively closely to upper and lower edges 11 and 12, respectively, of the side wall 5. An access means, namely, a slit 18 extends from each aperture 15 to the adjacent edge 11 or 12 for accommodating quick entry of the ligature 7 into the corresponding apertures 15.

The upper and lower rings 3 and 4 are of plastics material, and are similar to each other with the exception that the upper ring 3 is of smaller diameter than the lower ring 4 for accommodating the frusto conical shape of the side wall 5. A plurality of ligature receiving means, namely, hooks 44 for engaging the ligature 7 extend from the rings 3 and 4, in a direction generally inwardly towards a centre 45 defined by the respective rings 3 and 4. One aperture 15 is provided in the respective upper and lower rows 42 and 43 of apertures 15 for each hook 44. Grooves 46 extend radially through the rings 3 and 4 adjacent the hooks 44 for accommodating loops 47 of the ligature 7 from the apertures 15 to corresponding hooks 44. For the purpose of minimising the volume of plastics material required for the upper and lower rings 3 and 4, recesses 48 are formed in portions 49 of the respective rings 3 and 4 between the hooks 44. A wall 50 of one of the portions 49 is provided with four slots 51 for engaging and securing the two ends 52 of the ligature 7.

The method for making the lampshade 1 of FIGS. 14 to 17 will now be described. For convenience the side wall 5 is initially secured to the lower ring 4, and is then secured to the upper ring 3. With the side wall 5 formed into the frusto conical shape the lower ring 4 is engaged within the side wall 5 adjacent its lower edge 12. During this operation, and during the securing of the side wall 2 to the lower ring 4 the side wall 5 is inverted so that the lower edge 12 is facing upwards. The apertures 15 are aligned with the grooves 46 in the lower ring 4. One end 52 of the ligature 7 is secured in one of the slots 51 in the lower ring 4. The ligature 7 is then hooked onto the adjacent hook 44 and is passed through the corresponding groove 46, and is passed through and is entered in the adjacent aperture 15 of the side wall 5 by entering the ligature 7 through the corresponding slit 18. A loop 47 is then formed in the ligature 7, and the loop 47 is entered into the next adjacent aperture 15 through the slit 18, and the loop 47 is in turn looped onto the corresponding hooks 44, and a free portion of the ligature 7 is pulled until the loop 47 tightly engages the hook 44, thereby retaining the adjacent portion of the side wall 5 to the lower ring 4. Another loop 47 is formed and entered into the aperture 15 and is looped onto the corresponding hook 44, and a further free portion of the ligature 7 is pulled tightly thereby tightening the ligature 7 onto the hook 47 for further securing the side wall 5 onto the lower ring 4. This operation continues until loops 47 have been entered into all the apertures 15 and looped onto the corresponding hooks 44. The other free end 52 of the ligature 7 is then engaged in one of the other slots 51 so that both free ends 52 of the ligature 7 are secured in the slots 52. On the side wall 5 having been secured to the lower ring 4, the side wall 5 is then secured to the upper ring 3. For convenience the side wall 5 is reinverted so that the upper edge 11 faces upwardly.

Alternatively, instead of forming loops 47 prior to the loop 47 being looped onto the corresponding hook 44, the ligature could be secured in the following fashion. After securing one end 52 to the lower ring 4 and hooking the ligature 7 onto the adjacent hook 44, and in turn entering the ligature into the corresponding aperture 15, the ligature 7 without forming a loop 47 could then be entered into the next aperture 15 through the corresponding slit 18, and then could be looped around the hook 44 and passed back out through the groove 46 and that aperture 15 before being entered into the next adjacent aperture 15 through the corresponding slit 18, and so on.

While the lampshade 1 has been described as comprising a side wall 5 which is effectively endless, it is envisaged that the lampshade may be of the type comprising an upper ring and a lower ring with one or a plurality of side walls extending between the upper and lower rings. The side walls may be located adjacent each other, or may be spaced apart.

It will of course be appreciated that while the side wall has been described as being of a plastics material, the side wall may be of any other material, for example, paperboard, plastics, styrene, fabric or paper, which may be laminated to paperboard, plastics or styrene, or any other suitable material. Additionally, the side wall may be rigid, semi-rigid or indeed, flexible. It is also envisaged that upper and lower rings of other shape and construction may be provided. The upper and lower rings may be of any suitable material, for example, wood, metal, plastics, styrene, wire, or the like. It is envisaged that the lampshade may comprise only one ring, for example, a lower ring, and in other cases, it is envisaged that the upper and lower rings 3 and 4 may be joined by connecting members.

Furthermore in the embodiment described in FIGS. 14 to 17, it is envisaged that a closure ring may be provided for closing the recess in the upper and lower rings. Ligature receiving means other than hooks 44 may also be provided. Where the receiving means are provided by hooks 44, the hooks 44 may extend in any desired direction from the rings 3 and 4.

While it is preferable, it is not essential that access means to the corresponding apertures should be provided. In the absence of access means to the respective apertures, each loop would be threaded through a corresponding aperture.

While the ligature has been described as being of leather, the ligature may be of any other suitable material.

What is claimed is:

1. A method for making a lampshade of the type which comprises at least one support ring having a plurality of ligature receiving means at spaced apart locations along the support ring, and a side wall secured to the at least one support ring by a ligature, the side wall having a plurality of spaced apart apertures formed therethrough for receiving the ligature, the method comprising the steps of:

inserting respective portions of the ligature sequentially into the wall apertures, and securing the respective portions of the ligature to the ligature receiving means on the corresponding support ring.

2. A method as claimed in claim 1 in which a first access means is provided to each wall aperture, the respective first access means extending from a side edge of the side wail adjacent the wall apertures to the corresponding wall aperture for accommodating the corresponding portion of the ligature into the corresponding wall apertures.

3. A method as claimed in claim 2 in which a second access means is provided in each support ring to each ligature receiving means for accommodating respective portions of the ligature to the corresponding ligature receiving means.

4. A method as claimed in claim 3 in which each ligature receiving means is formed by an aperture extending through the corresponding support ring, and prior to inserting the portions of the ligature into the corresponding wall and ring apertures, the respective wall and ring apertures and their corresponding first and second access means are aligned for receiving the said portions of the ligature.

5. A method as claimed in claim 4 in which the ligature is inserted through respective adjacent wall and ring apertures to give the effect of a helically wound ligature around the corresponding support ring and a portion of the side wall intermediate the wall apertures and the adjacent side edge of the side wall.

6. A method as claimed in claim 3 in which each first and second access means is provided by a respective first and second access slit or slot.

7. A method as claimed in claim 5 in which the portion of the ligature adjacent the outer side of the side wall adjacent the side edge is held adjacent the first access slot for preventing the ligature from being pulled through the first access slot a second time, and the ligature is pulled taut each time a portion of the ligature is inserted through one of the wall and ring apertures for tightening a portion of the ligature extending between that wall and ring aperture and the next adjacent wall and ring aperture through which the ligature had previously been inserted.

8. A method as claimed in claim 1 in which each ligature receiving means comprises a grip means located in the corresponding support ring.

9. A method as claimed in claim 8 in which each grip means is located in a corresponding second aperture in each support ring, the respective portions of the ligature being inserted through the respective corresponding wall apertures for engaging the grip means.

10. A method as claimed in claim 1 in which the ligature is secured to one or more of the ligature receiving means on the corresponding support ring at least every second time a portion of the ligature is passed through one of the wall apertures and the ligature is tightened onto the ligature receiving means.

11. A method as claimed in claim 10 in which the ligature is secured to one of the ligature receiving means each time a portion of the ligature is passed through one of the wall apertures.

12. A method as claimed in claim 10 in which the portions of the ligature are passed through the wall apertures to form respective loops, each loop being secured to a corresponding one of the ligature receiving means.

13. A lampshade comprising:

a side wall having a top and a bottom edge and a plurality of ligature receiving apertures formed in the side wall at spaced apart intervals adjacent at least one of the top and bottom edges, at least one support ring located adjacent at least one of the top and bottom edges of the side wall, and a ligature securing the side wall to the at least one support ring, wherein a plurality of spaced apart ligature receiving means are provided on the at least one support ring aligned with the respective corresponding ligature receiving wall apertures, and a plurality of portions of the ligature extend through the respective wall apertures and are engaged on the respective ligature receiving means on the support ring for securing the side wall to the at least one support ring.

14. A lampshade as claimed in claim 13 in which each ligature receiving means comprises a grip means for receiving and securing the ligature in the corresponding support ring.

15. A lampshade as claimed in claim 14 in which each grip means is located in a corresponding second aperture which extends through the corresponding support ring.

16. A lampshade as claimed in claim 13 in which the ligature is in the form of a plurality of loops extending through the respective wall apertures, the loops engaging corresponding ligature receiving means.

17. A lampshade as claimed in claim 16 in which each ligature receiving means comprises a hook.

18. A lampshade as claimed in any of claim 13 in which a first access means is provided to each wall aperture, each first access means extending from an adjacent side edge of the side wall to the corresponding wall aperture for accommodating the ligature into the wall aperture.

19. A lampshade as claimed in claim 13 in which a second access means is provided in each support ring to each ligature receiving means, each second access means extending from a side edge of the corresponding support ring which corresponds with a side edge of the side wall to the corresponding receiving means for accommodating the ligature into the ligature receiving means.

20. A lampshade as claimed in claim 19 in which each of the first and second access means comprises a respective first and second access slit or slot.

21. A lampshade as claimed in claim 20 in which the respective first and second access slots are inclined relative to the adjacent side edges of the side wall.

22. A lampshade as clam ed in claim 20 in which portions of the ligature extending from the respective wall apertures to the adjacent side edge of the side wall lie along and conceal the corresponding first access slots.

23. A lampshade as claimed in claim 13 in which a pair of support rings are provided, one of the pair of support rings being a top support ring and the other of the pair of support rings being a bottom support ring, the top and bottom support rings being spaced apart from each other, and the side wall extending between and completely around the top and bottom support rings.

24. A lampshade comprising at least one support ring and a side wall secured to the support ring by a ligature wherein the support ring comprises a plurality of spaced apart ligature receiving means, and a plurality of spaced apart apertures are formed in the side wall adjacent the supporting for receiving the ligature, the ligature extending sequentially through the apertures and being secured to the respective ligature receiving means, the ligature being passed over at least one ligature receiving means at least every second time the ligature is passed through one of the apertures without the need for winding the ligature in helical form around the support ring.

* * * * *